US005762239A

United States Patent [19]

Cossette

[11] Patent Number: 5,762,239

[45] Date of Patent: Jun. 9, 1998

[54] HAND HELD SCELLANT APPLICATOR

[76] Inventor: André Cossette, 9982, Carré Prével, Québec, QC, Canada, G2B 2N6

[21] Appl. No.: 663,744

[22] Filed: Jun. 14, 1996

[51] Int. Cl.[6] ..... B67D 5/46

[52] U.S. Cl. ..... 222/326; 222/333; 222/390

[58] Field of Search ..... 222/325–327, 222/333, 390

[56] References Cited

U.S. PATENT DOCUMENTS

| | | | |
|---|---|---|---|
| 2,644,581 | 7/1953 | Humphreys | 222/325 |
| 3,208,638 | 9/1965 | Frenzel et al. | 222/333 |
| 3,242,881 | 3/1966 | Schafer | 222/333 |
| 3,946,908 | 3/1976 | Yoon | 222/327 |
| 4,114,781 | 9/1978 | Doyel | 222/326 |
| 4,171,072 | 10/1979 | Davis | 222/326 |
| 4,180,187 | 12/1979 | Ben-Haim | 222/326 |
| 4,335,834 | 6/1982 | Zepkin | 222/327 |
| 5,375,740 | 12/1994 | Umetsu et al. | 222/327 |
| 5,450,988 | 9/1995 | Jerdee | 222/333 |

FOREIGN PATENT DOCUMENTS 2134144 4/1996 Canada .

*Primary Examiner*—J. Casimer Jacyna

[57] ABSTRACT

A hand held scellant applicator has a graspable housing and a drive mechanism housed therein. An endless vise is provided with a torque arm slidingly mounted to the housing. A large gear concentrically installed around the vise is held in place by a roller bearing rotating central part, surrounded by balls turning within an outside part mounted on the housing. The vise has inclined planes, and the central part of the bearing has mating planes which ride on the inclined planes of the vise, the rotation of the large gear causing the advance of the vise and the torque arm preventing the rotation of the vise. At pivoting coupling housing disengages the large gear to permit removal of the vise after pushing the scellant out.

14 Claims, 7 Drawing Sheets

HAND HELD SCELLANT APPLICATOR

BACKGROUND OF THE INVENTION

Field of the Invention

This invention relates to the field of paste such as scellant applicators and particularly that of hand held caulking guns. This invention is for an apparatus that is used to apply a scellant found in a tube, by providing a battery operated drive mechanism which rectilinearly displaces a torsaded rod acting against a dish plate which pushes a scellant compound through a nozzle extruder. Description of the Related Art including information disclosed under 37 CFR 1.97–1.99 A patent search revealed a number of patents wherein an electric chord mechanism is used to provide ample force for caulking. U.S. Pat. No. 9,450,988 Jerdee,19 Sept. 1995 shows an endless caulking gun having a ball driven rod Fig.7 with helical threads on the rod, wherein, when a trigger is actuated a drive sleeve 82 moves from a first OFF position to a second ON position when the ball 80 is lowered. The engagement of a ball 80 into threads of a threaded rod 30 forces the displacement of the rod 30 and plate 28. The rod turns. The keyway rotates the rod, and the ball makes the rod move forward. Triggering the ball into position does not provide an infinitely variable speed for clean uniform applications. A manual dimmer switch may be used as a separate variable speed dimmer. U.S. Pat. No. 4,180,187 Ben-Haim, 25 Dec. 1979, shows a gun for paste comprising a motor, a gear chain which entrains a piston, and a rotative gear engagement. U.S. Pat No. 4,171,072 Davis, 16 Oct. 1979. Gun with electric cable, provides variable speed by means of two plaques 25 and 49, separated by a spring 50. The force required by the several intermeshing gears is that provided by an electric powered motor but is not likely to be achieved by a battery powered motor. The chain 33 may not be removed but a clutch release member 50 is used to retrieve the torsaded rod 20.

The initial idea was to install a variable triggered switch motorized vise pusher in the back end of a paste, such as in a caulking tube, by providing a pusher rod which can be readily retrieved. Conventional pumping systems offer a human effort in the application of such compound, resulting in strain and inconstant application.

SUMMARY OF THE INVENTION

A general objective of the present invention is to provide a motorized hand caulking gun that ensures ease of application of a compound such as an acrylic, silicone etc. .

A second objective of my invention is to provide a motor with a rechargeable battery compatible with most common chargers in the market, ensuring a transportable device comparable to any plug in accessory, without having a cumbersome electrical wire. More particularly to incorporate a variable trigger switch motor drive for applying precise manual control.

Thirdly, to provide a non rotating rod incorporating inclined planes to be acted upon by a surrounding gear for providing back and forth movement. Also, for providing a removable tube support, with different options of tubes, in types and sizes, the retrieval of the pushed rod, for removing the tube, being carried out after tilting disengagement of transmission box attached to a motor otherwise engaging the surrounding gear.

Finally, to provide a structure which may utilize plastic component elements of drive, to ensure a low weight caulking gun, easy to manipulate and defined as:

A hand held paste applicator having in combination: a body case comprising a lower compartment, a medium compartment and a head compartment, the compartments being superimposed to define a general vertical direction, the medium compartment adapted to be held in a hand, a tube holder protruding from the head compartment, the tube holder defining a central axis passing through the head compartment, the tube holder adapted to support a tube contained scellant, a torsaded rod with inclined planes helicoidally wound along the central axis, the torsaded rod comprising a torque arm slidingly secured to the head compartment, for keeping the torsaded rod from rotating, the torsaded rod further comprising a cup to push upon the tube contained scellant, rotating pushing means engaging the inclined planes of the torsaded rod about the central axis, thereby linearly displacing the torsaded rod along the central axis and the cup means against the tube contained scellant, thereby causing the application of the scellant.

BRIEF DESCRIPTION OF DRAWINGS

Still further objects and advantages will become apparent from the consideration of the ensuing description and drawings wherein closely related figures: have the same numbers but different alphabetic suffixes and wherein like numbers refer to like parts.

DESCRIPTION OF THE PREFERRED EMBODIMENT

Figure 1A:
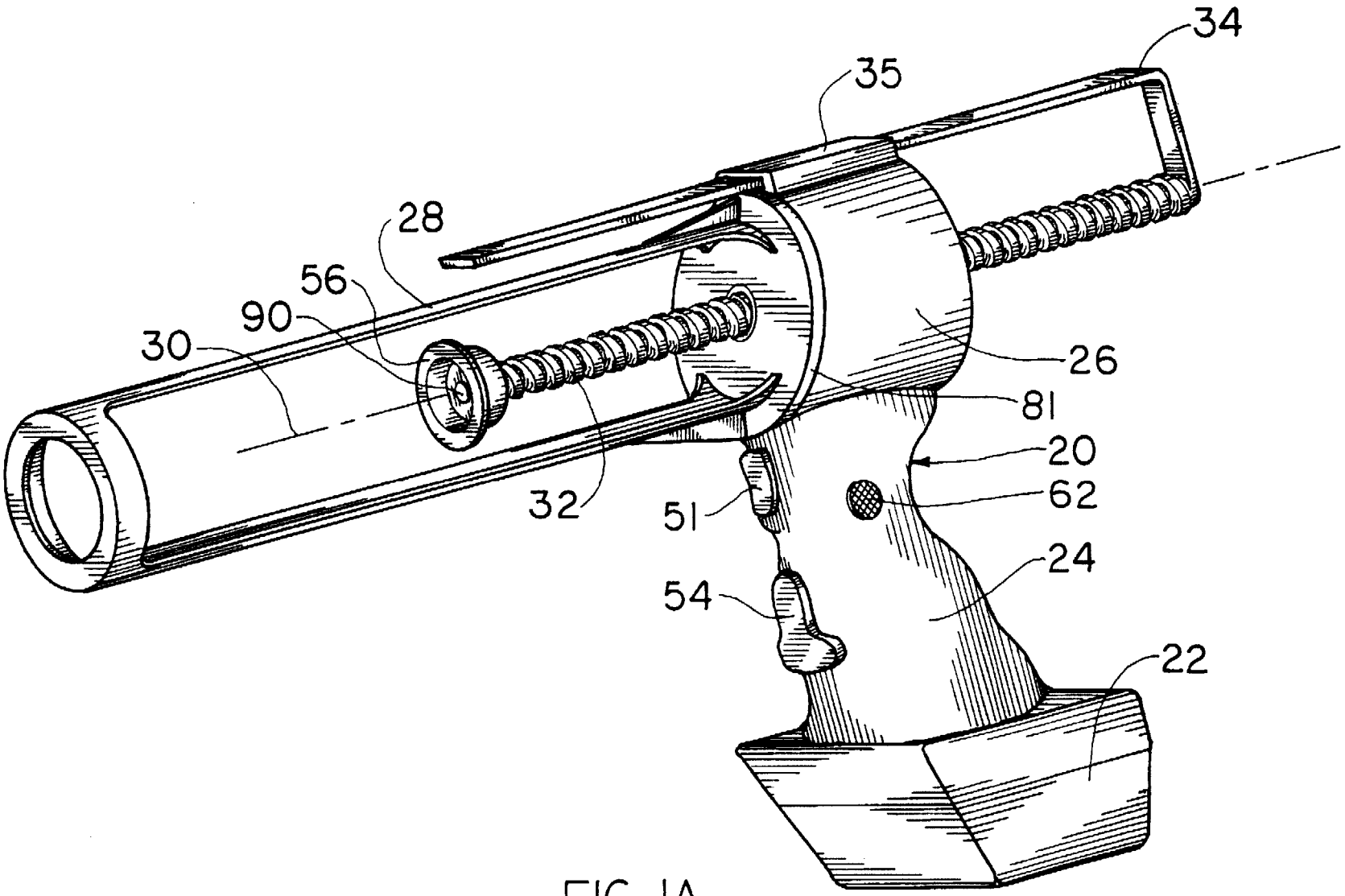
FIG.1A is a perspective of a caulking gun hand held scellant applicator

An embodiment of the invention is described in the following figures of above drawing and particularly in FIG.1A thereof, showing a hand held scellant applicator comprising a body case 20 having three superimposed compartments; a lower compartment 22, a medium compartment 24 and a head compartment 26. A tube holder 28 having a central axis 30 passes through the head compartment 26. A preferred material for the body case 20 and the tube holder 28 is plastic in order to minimize the weight.

Figure 1B:
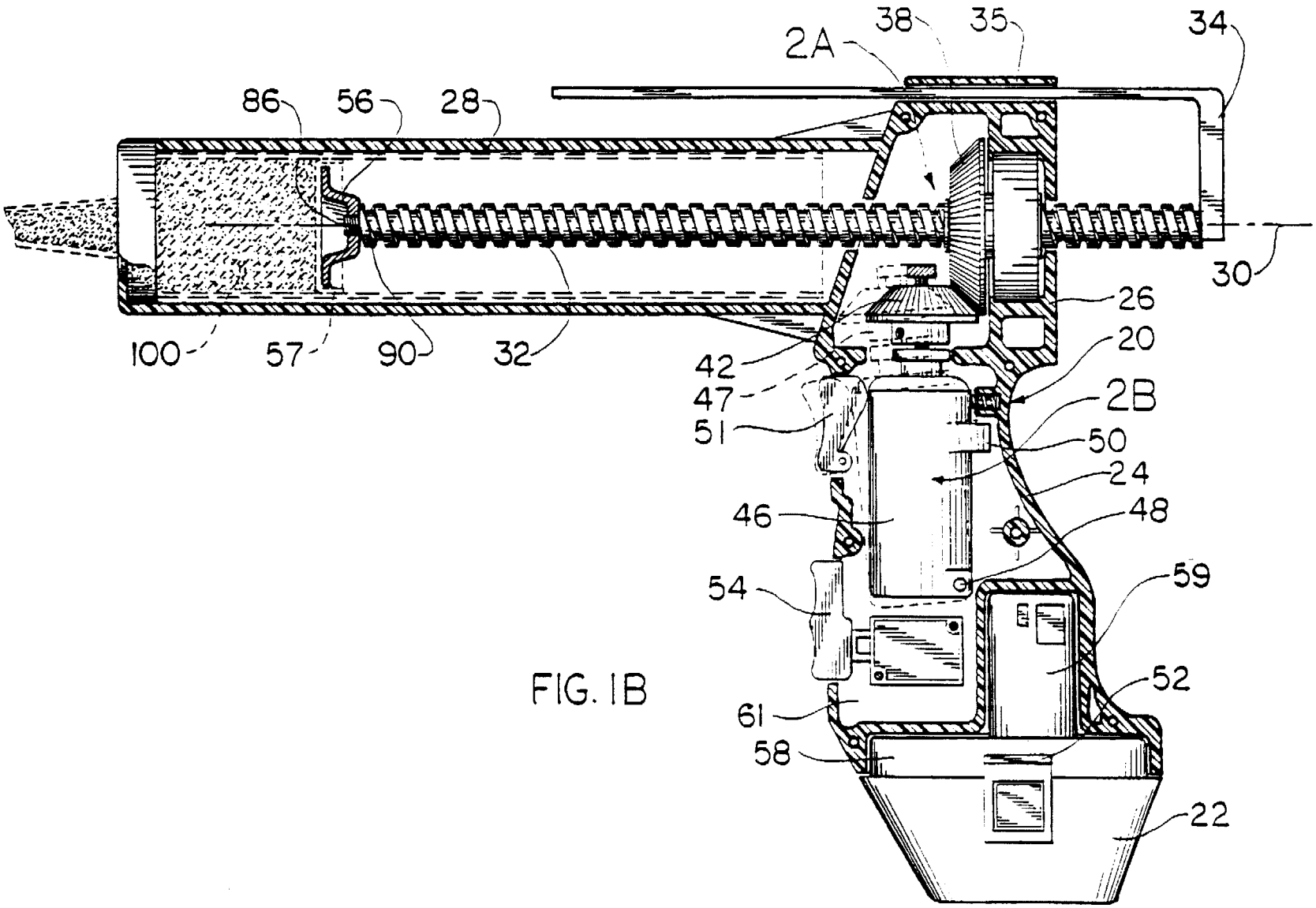
FIG.1B is a cut view of the applicator of FIG. 1A

Inside the tube holder 28, a torsaded rod 32 is sliding back and forth along the central axis 30 and has a removable cup 56, at a pushing end 90, and a torque arm 34 at a head end. The torsaded rod 32 is bent 180° to form the torque arm 34, sliding in a guide 35, mounted in the head compartment 26, thus preventing the torsaded rod 32 from rotating. The medium compartment 24 comprises a variant switch 54, a finger button 51 and a push button 62. When actuating the variant switch 54, which is of a trigger switch type, the torsaded rod 32 and the cup 56 are displaced in a pushing direction, away from the head compartment 26. The push button 62 allows, when pushed, the disengaging of the shell 46 and permits the retrieval of the torsaded rod 32, by hand pulling of the torque arm 34, thereby permitting the replacement of a scellant tube. Depressing the finger button 51 permits the actuation of the shell 46 to push the torsaded rod 32. The lower compartment 22 of the body case 20 shows a power pack block 58-to activate a DC motor 36-FIG.2A-housed a shell 46. FIG.1B further shows a detail of the inside mechanism and particularly the torsaded rod 32 mounted in the tube holder 28 surrounded by a large gear 38 which is driven by a small gear 42. The small gear 42 and the large gear 38, preferably made of plastic, being beveled gears and mounted 90° with gear ratio such as to transmit power at a preferable reduction ratio of 4 to 1. The small gear 42 protrudes from the shell 46 in a shared junction 47 between medium compartment 24 and head compartment 26. The shell 46 next to block 58. Normally a power pack block 58 has a male part 59 for adapting to a battery charger. A cavity 61 left in the medium compartment 24 next to the male part 59 serves to house the trigger variant switch 54 and to locate the pivot point 48. The battery in the male part 59 is located very close to the variant switch 54 and the DC motor 36-FIG.2A-in the shell 46 and as a result needs no electric cables but simple direct contacts between DC motor 36, variant switch 54 and male part 59 with its batteries. In a preferred embodiment the power pack 58 contains six batteries of 1.2 volts, making 7.2 volts of power.

A snap 50, mounted on shell 46 engages though the medium compartment 24, thereby keeping the small gear 42 in engagement with large gear 38. When push button 62-FIG.2D-is pushed, the snap 50 is released. Spring 49 pushing against shell 46 displaces shell 46 about pivot 48, until pops out finger button 51 from the shell 46 and along with the displacement of the shell 46, small gear 42 is disengaged from large gear 38. The pushing action of the finger button 51, reengages snap 50 in the medium compartment 24, thereby securing the small gear into large gear 38. At this position an operator actuates the variant switch 54, located under the finger button 51, to proportionally power DC motor 36 to move the torsaded rod 32 forward, pushing the scellant out of the tube at a desired rate.

Figure 2A:
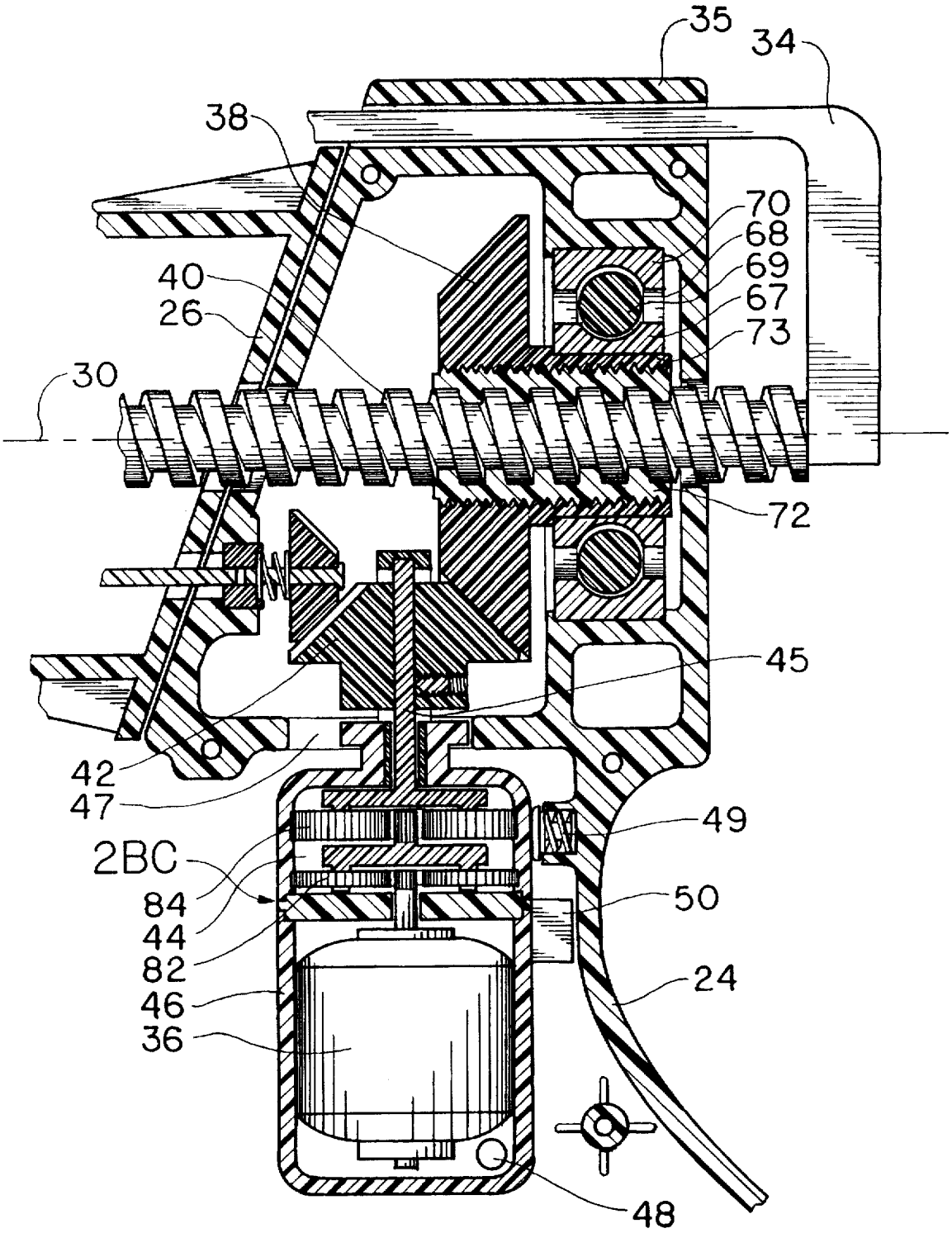
FIG.2A is a cut view in region of arrow 2A of FIG. 1B

FIG.2A shows a section of the head compartment 26, a shared junction 47 and a part of medium compartment 24. The shell 46 is mounted on pivot 48, in an engaged position, by snap 50 in the medium compartment 24, with the small gear 42 engaged in the large gear 38. For ease of replacement of the threaded core 72, the large gear 38 has an annular protrusion 73 protruding into an inner annulus 67 of bearing 68 and screwed over the threaded core 72 located between the large gear 38 and the torsaded rod 32. The threaded core 72 inner face contacting torsaded rod 32, is provided with 1.25 threads per inch (tpi) with 2 entrances, and the outer face contacting the annular protrusion 73, is provided with permanent assembly threads. The threaded core 72 by its rotation causes sliding against the inclined planes 40 of the torsaded rod 32 and pushes the torsaded rod 32 along the central axis 30. The inner annulus 67 is surrounded by roll means 69 resting against an outer annulus 70 gripped in the head compartment 26, thereby giving large gear 38 a support for rotation.

Figure 2C:
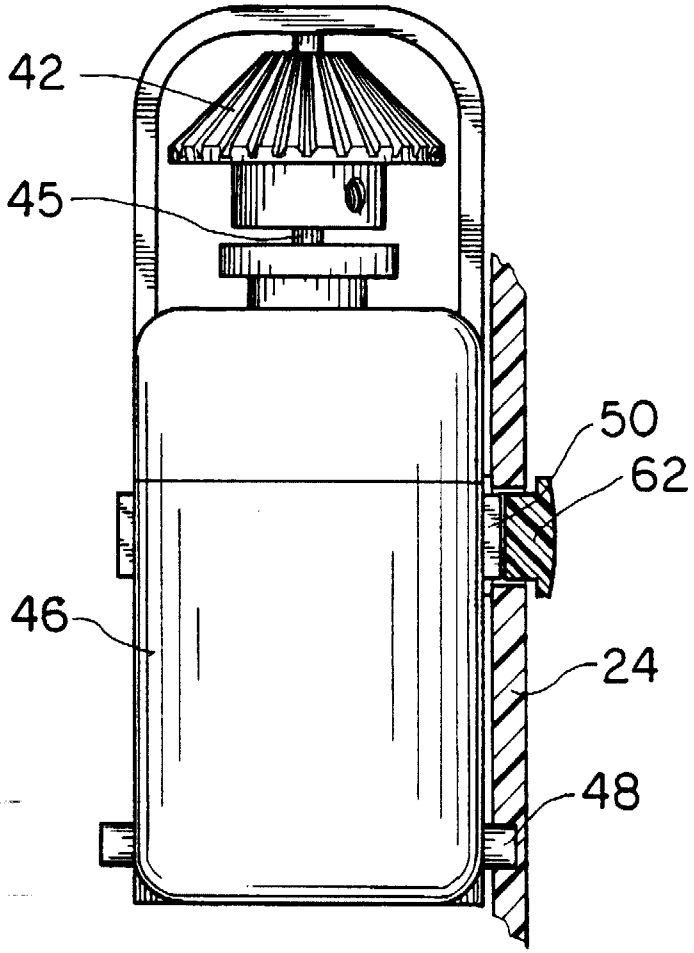
FIG.2C is a side view in region of arrow 2BC of FIG.2A
Figure 2B:
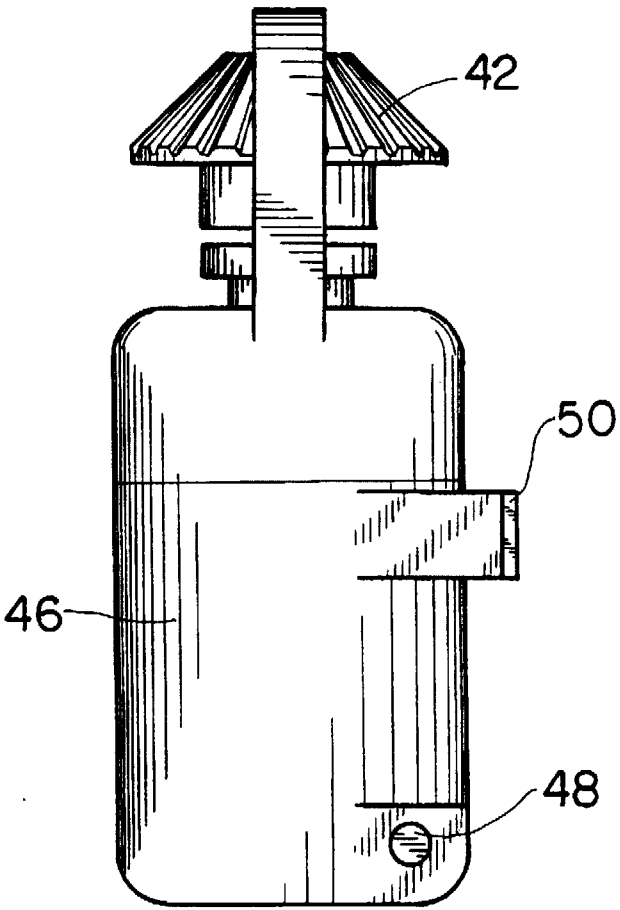
FIG.2B is a front view in region of arrow 2BC of FIG.2A
Figure 2D:
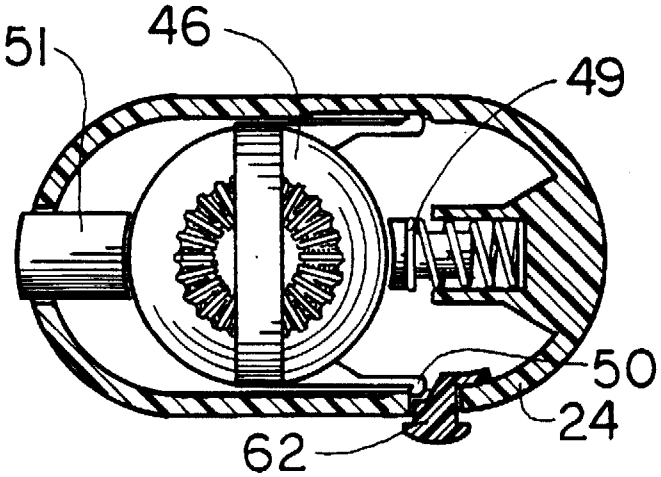
FIG.2D is a top view with cut assembly of FIG.2B

The shell 46 holds the DC motor 36 a transmission 44 composed of a lower planetary gear 82 and an upper planetary gear 84 having a 10 to 1 reduction ratio, and supporting the small gear 42 by a steel shafting 45 protruding outside the shell 46, in the shared junction 47 FIGS.2B, 2C and 2D show front view, side view and a top view of the shell 46 comprising, at the bottom, a pivot 48 which preferably is a pin protruding from the shell in order to be accommodated by the medium compartment 24. In the center of the shell 46, the snap 50, when engaged in the medium compartment 24 resists displacement about pivot 48 despite the pushing of spring 49 against the shell 46. The snap 50 is a spring disengaged from medium compartment 24 by a push button 62. Two snaps 50 may be used. The shafting 45 protruding from the shell 46 commands and supports the small gear 42. The small gear 42 being beveled and screw mounted on the shafting 45 a avoids pure cantilever of the small gear 42 and shafting gear 45. FIG.3A illustrates a perspective view of a dismountable engagement of the caulking gun tube support 94 on the head compartment 26. The tube support 94 comprises a number of T ribs 92 adapted to be engaged or disengaged from female grooves 96 on the head compartment 26. Preferably an angle of-19-degrees maintains the tube support 94 in a junction face 81 by the pushing action of the cup 56 on the scellant, caused by the rotation of the threaded core 72 against inclined planes 40 of the symmetric rod 74.

Figure 4:
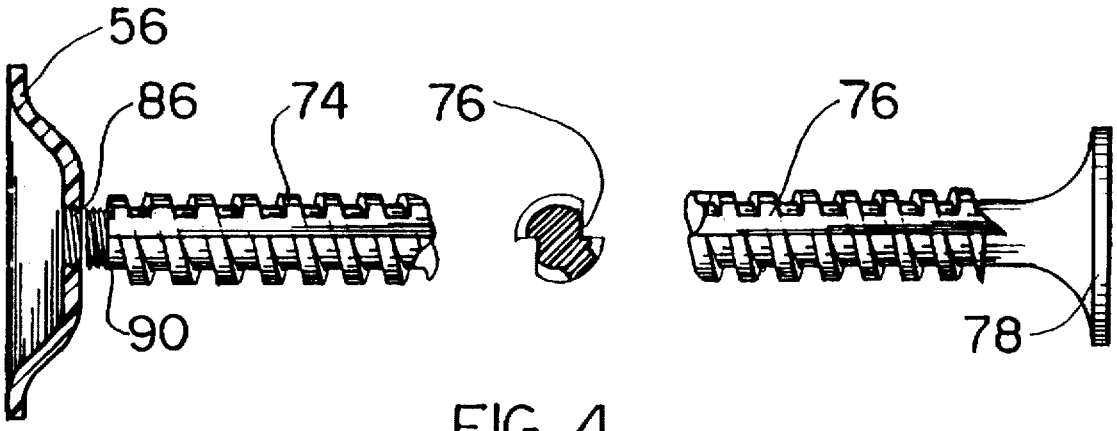
FIG.4 shows an alternative, with cut, of part 32 of FIG.1B

The symmetric rod 74-FIG.4-comprises two keyways 76 preferably V shaped and adapted on each side of the symmetric rod 74 to be engaged by a key 80 integrated in the head compartment 26. The key 80 is preferably off center in order to give more support area from a clockwise rotation when the cup 56 pushes against a scellant. The key 80 keeps the symmetric rod 74 from rotating and permits the push action of the inclined planes 40 of the symmetric rod 74. The cup 56 as a means of pushing against the scellant can be preferably screwed dismountable on a threaded end 86 of the symmetric rod 74 pushing end 90-FIG.1B-to allow retrieving from the head compartment 26 by pulling mushroom 78 when the snaps 50 are released.

Figure 3B:
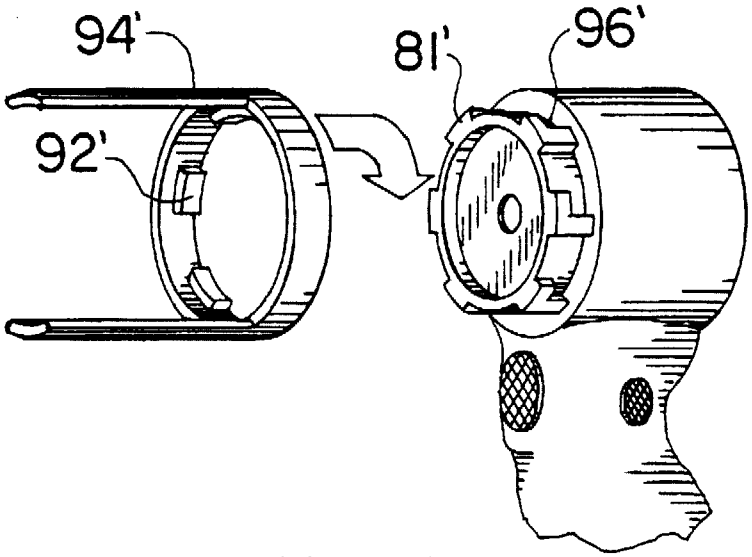
FIG.3B is a perspective of a second alternative to the gun of FIG.1A
Figure 3A:
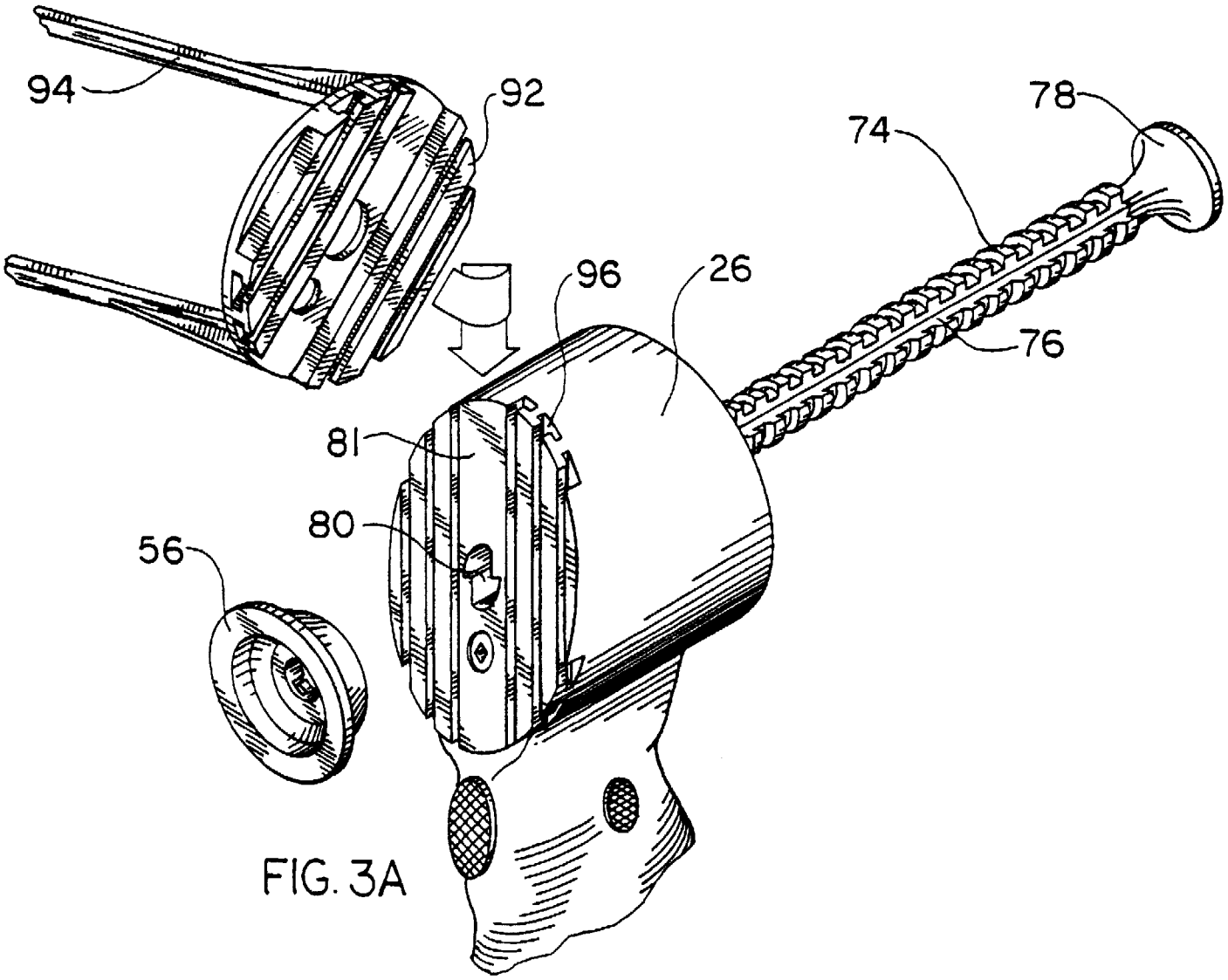
FIG.3A is an exploded view of an alternative to the gun of FIG.1A
Figure 5:
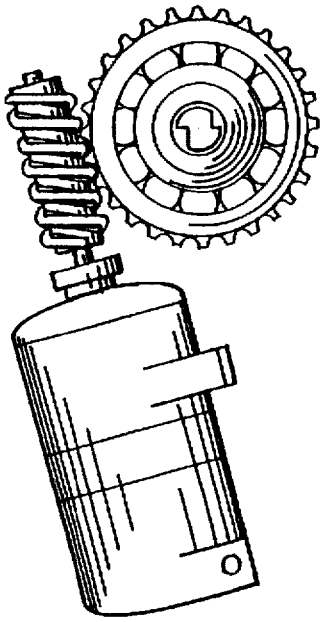
FIG.5 is a side view of a partial alternative to the gun of FIG.1B

FIG. 3B shows another embodiment engaging a dismountable tube holder having a fit and twist connection wherein a T rib 92' has a male engaged in female grooves in a vertical jonction face 81' and by a 10 to 25 degree twist rotation securing the T rib 92' in the head compartment 26'. There may be different T rib 92 configurations, such as for a commercial tube holder having a size 3"×13" long, with a cup 56 of 2 ½" diameter. A tube holder may be twin, in order to receive two T ribs for epoxy 92 mix the second tube utilizing the pushing capacity of the torque arm. Another configuration-FIG.5-could involve replacing the small gear 42 by a worm gear, and a spur gear designed to match the worm gear replacing beveled large gear 38.

Discussion of some of the elements of the invention

The rotating pushing means comprise: large gear means mounted in the head compartment around and perpendicurlary of the central axis, such as a large gear having a threaded core adapted to slidingly contact the inclined planes of the torsaded rod, small gear means such as a small gear adapted to engage the large gear and disengage from the large gear, motor means such as a DC motor mounted in the medium compartment and comprising transmission means installed between the motor and the small gear and commanding the small gear, battery means for providing power to the motor, such as a battery comprising variant switch means, the depression of the variant switch by a hand causing the providing of power to the motor.

Means for mounting the large gear comprise: an annular protrusion of the threaded core surrounding the torsaded rod, a central bearing with an inner annulus, grip mounted to the annular protrusion and turning within roll means mounted in an outer annulus, the outer annulus being rigidly mounted in the head compartment.

Means for disengaging the small gear comprise: a shell, housing the motor, the transmission and the small gear, the shell being pivotedly mounted at a pivot point in the medium compartment and being extended into a shared junction of the medium compartment with the head compartment, spring means such as a compression spring mounted in the medium compartment and biased against the shell, snap means such as two snaps mounted on the shell and protruding into a locking position in the medium compartment, a handle button mounted on the medium compartment and adapted for causing the release of the snaps from a locking position, the shell being urged away from the large gear, thereby disengaging the small gear from the large gear and permitting the free withdrawal of the torsaded rod from the threaded core, along the central axis.

Mode of operation

Mount an appropriate size tube holder 28 onto head compartment 26. Retrieve torsaded rod 32 to a far position. Insert a tube. Engage cup 56 into scellant tube until the end dish 57 is contacted. Insure a battery block 58 is loaded. Depress finger button 51 to engage transmission. Depress variant switch trigger 54 to move torsaded rod. Apply the compound 100 at the desired rate. At the end, disengage transmission by push button 62, to disengage small gear 42 from large gear 38. Grasp torque arm 34, at a mushroom 78, and pull back to cause free reverse rotation of large gear 38. When rod is pulled back remove tube and replace.

Special Embodiments

The lower compartment comprises a block adapted for a number of batteries and comprises a number of steel plates adapted for linking the batteries, the lower compartment pivoting around a compartment pivot attached to the medium compartment. The motor comprises a 7.2 volt motor driven by the variant trigger switch and a set of 6 batteries of 1.2 volts. I have used a 9.6 volt battery arrangement in commercial applications.

The torque arm comprises an L member mounted perpendicularly of the torsaded rod and adapted to slide in a guide in the head compartment along a line parallel to the central axis. The torsaded rod may be a symmetric rod and the torque arm comprise a keyway practiced all along the torsaded symmetric rod ended by a mushroom, the keyway adapted for sliding over a key held by the head compartment thereby providing torque means to avoid rotation of the torsade.

The junction face 81 is within a range of angles from 12 to 25 degrees from the general vertical direction and the tube support is adapted to engage the junction face along the range of angles.

An auxiliary gear may be added to the small gear 42 and be provided with a spring to permit its retraction when the small gear is disengaged. While the present invention has been shown in the drawings and fully described above with particularity and detail in connection with what is presently deemed to be the most practical and preferred embodiment (s) of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desires to be protected by Letters Patent of the United States is as follows:

1. A hand held paste applicator having in combination:

a body case (20) comprising a lower compartment (22) a medium compartment (24) and a head compartment (26), said compartments being superimposed to define a general vertical direction, said medium compartment (24) adapted to be held in a hand.

a tube holder (28) protruding from said head compartment (26) at substantially 90° angle with said body case (20), said tube holder (28) defining a central axis (30) passing through said head compartment (26), said tube holder (28) adapted to support a paste containing tube, a torsaded rod (32) with inclined planes (40) helicoidally wound thereabout, said torsaded rod disposed and extending through said head compartment along said central axis (30) and having a pitch between 1 and 3 threads per inch, said torsaded rod having a front end and a rear end, torque arm means secured to said head compartment (26), for keeping said torsaded rod (32) from rotating, a pushing end (90) fixed to said front end of said torsaded rod, to push said paste carried by said paste containing tube, rotating pushing means meshing with said torsaded rod (32) for linearly displacing said torsaded rod (32) along said central axis (30), said rotating pushing means comprising:

large gear means (38) journalled in said head compartment (26) for rotation about said central axis (30), said large gear means (38) further comprising a threaded core (72) meshing with said torsaded rod (32), by contact with said inclined planes, small gear means (42) meshing with said large gear means (38), motor means (36) and transmission means (44) mounted in said medium compartment (24), said motor means (36) driving said small gear means (42) through said transmission means (44), battery means (52) for providing power to said motor means (36), said battery means (52) comprising variant switch means (54), the depression of said variant switch means (54) causing the providing of power to cause rotation of said small gear means (42) at a selected variable speed, means for disengaging said small gear means (42) from said large gear means (38) comprising a shell (46) housing said motor means (36) and said transmission means (44) and carrying said small gear means (42), said shell (46) being pivotedly mounted at a pivot point (48) in said medium compartment (24) and spring means (49) mounted in said medium compartment (24) and biasing said shell (46) to a first pivoted position in which said small gear means is disengaged from said large gear means.

2. The applicator of claim 1 wherein said means for disengaging further comprise:

snap means (50) mounted on said shell (46) and releasably engageable with said medium compartment (24), for locking said shell in a second position wherein said small gear means is engaged with said large gear means, a push button (62) mounted on said medium compartment (24) and adapted for causing the release of said snap means (50).

3. The applicator of claim 1, wherein said torsaded rod has two entrances, thereby defining two parallel sets of inclined planes.

4. The applicator of claim 3 wherein said transmission means (44) comprise in combination a lower planetary gear (82) and an upper planetary gear (84), said lower planetary gear (82) mounted to said motor means (36) in said shell

(46) and coupled to said upper planetary gear (84) commanding said small gear means (42).

5. The applicator of claim 1 wherein said means for mounting comprise:

an annular protrusion (73) of said large gear means (38) and extending externally of said threaded core (72).

a central bearing (68) with an inner annulus (67) grip mounted around said annular protrusion (73) and turning within roll means (69) mounted in an outer annulus (70), said outer annulus (70) being rigidly mounted in said head compartment (26).

6. The applicator of claim 1 wherein said lower compartment (22) comprises a block (58) adapted for a number of batteries and comprises means for linking said batteries and providing power to said variant switch means (54), said block (58) having a male part (59) protruding into said medium compartment (24), leaving space cavity (61) thereabout.

7. The applicator of claim 6 wherein said motor means (36) comprise a 7 to 10 volt motor driven by said variant switch means (54) and a set of 6 to 9 batteries of 1.2 volts.

8. The applicator of claim 6 wherein said male part (59) is located in direct line below said large gear means (38) and said cavity (61) is below said small gear means (42) and permits a location of said pivot point (48), in direct line below said small gear means (42) to permit angular displacement away from said large gear means (38), said cavity (61) being of sufficient size to permit the housing of said variant switch means (54) close to said male part (59) and to said motor means, thus permitting a common current connection.

9. The applicator of claim 1 wherein said torque arm means is a torque arm (34) mounted perpendicularly on said torsaded rod (32) and having a U member of which one wing slides in a guide (35) in said head compartment (26) along a line parallel to said central axis (30).

10. The applicator of claim 1 wherein said tube holder (28) is provided with dismountable engagement means comprising a tube support (94) and a junction face (81) in said head compartment (26), said tube support (94) comprising a number of T ribs (92) adapted to engage a number of female grooves (96) mounted in said junction face (81), said T ribs (92) being slidingly inserted into said female grooves (96).

11. The applicator of claim 10 wherein said junction face (81) is within a range of angles from 12 to 25 degrees from said general vertical direction and said tube support (94) is adapted to engage said junction face (81) along said range of angles.

12. The applicator of claim 1 wherein said tube holder holds twist bayonnet arrangement (92') (FIG.3B) into said junction face (81).

13. The applicator of claim 1 wherein said torsaded rod is a symmetric torsade (74) and wherein said torque arm means comprise two keyways (76) of a V shape practiced all along said symmetric torsade (74), said keyways (76) adapted for sliding over a key (80) held by said head compartment (26), thereby providing torque means to avoid rotation of said symmetric torsade (74).

14. The applicator of claim 13 wherein said pushing end (90) comprises a cup (56) bayonnet mounted to said front end.

* * * * *